US006940374B2

(12) United States Patent
Nagahiro et al.

(10) Patent No.: US 6,940,374 B2
(45) Date of Patent: Sep. 6, 2005

(54) OVERLOAD/OPEN-PHASE TRIPPING DEVICE FOR CIRCUIT BREAKER

(75) Inventors: Isamu Nagahiro, Saitama (JP); Katsunori Kuboyama, Saitama (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 11/002,111

(22) Filed: Dec. 3, 2004

(65) Prior Publication Data

US 2005/0168305 A1 Aug. 4, 2005

(30) Foreign Application Priority Data

Feb. 3, 2004 (JP) ..... 2004-027174

(51) Int. Cl.[7] ..... H01H 75/08
(52) U.S. Cl. ..... 335/44; 337/41; 337/49
(58) Field of Search ..... 337/39, 46, 49, 337/75, 99, 101, 111, 145; 335/43–46

(56) References Cited

U.S. PATENT DOCUMENTS 4,642,597 A * 2/1987 Sako ..... 337/82
4,814,737 A * 3/1989 Ebnet ..... 337/49
4,845,455 A * 7/1989 Sako et al. ..... 337/49
5,767,762 A * 6/1998 Sako ..... 337/348
6,621,403 B2 * 9/2003 Nagahiro et al. ..... 337/75
6,816,055 B2 * 11/2004 Weber ..... 337/82

* cited by examiner

*Primary Examiner*—Lincoln Donovan
(74) *Attorney, Agent, or Firm*—Manabu Kanesaka

(57) ABSTRACT

An overload/open-phase tripping device for a circuit breaker includes a plurality of bimetallic elements arranged in a row; a differential shifter mechanism; and a tripping lever for transmitting a force applied by the differential shifter mechanism to a switching mechanism. The differential shifter mechanism includes a push shifter having a plurality of operation ends; a pull shifter having a plurality of operation ends; and a differential lever disposed between the push shifter and the pull shifter. The differential lever is provided with an action end for applying the force to the tripping lever upon an overload, and an action end for applying the force to the tripping lever upon an open-phase. The two action ends face the tripping lever, and the action end for the open-phase is located at a position farther from the tripping lever than the action end for the overload.

4 Claims, 6 Drawing Sheets

OVERLOAD/OPEN-PHASE TRIPPING DEVICE FOR CIRCUIT BREAKER

BACKGROUND OF THE INVENTION AND RELATED ART STATEMENT

The present invention relates to a thermal overload/open-phase tripping device mounted on a circuit breaker such as an auto-breaker.

With an auto-breaker as an example, FIGS. 5(*a*) and 5(*b*) show a structure of a circuit breaker with a thermal (bimetal type) overload/open-phase tripping device mounted thereon. A conventional thermal overload/open-phase tripping device has a structure shown in FIG. 6 (refer to Japanese Patent Publication (Kokai) No. 2002-298723).

In FIGS. 5(*a*) and 5(*b*), reference numeral 1 denotes a case of the circuit breaker; reference numeral 2 denotes a power supply side terminal; reference numeral 3 denotes a load side terminal; reference numeral 4 denotes a switching operation handle; reference numeral 5 denotes a switching mechanism; reference numeral 6 denotes a current cutoff section formed of movable and stationary contacts and an arc-extinguishing chamber; reference numeral 7 denotes an electromagnetic instantaneous tripping device; and numeral 8 denotes a thermal overload/open-phase tripping device.

As shown in FIG. 6, the thermal overload/open-phase tripping device 8 is formed of three main bimetallic elements 9, a differential shifter mechanism, and a tripping lever 13. The main bimetallic elements 9 correspond to respective phases (R, S, and T phases) of a main circuit, and are arranged in a row in the lateral direction, i.e. a direction of bending and restoration thereof. The differential shifter mechanism is formed of a push shifter 10, a pull shifter 11, and a differential lever 12, and contacts the main bimetallic elements 9. The tripping lever 13 functions as a compensating bimetallic element, and transmits a force due to an operation of the differential shifter mechanism to a latch receiver 5*a* incorporated in the switching mechanism 5, thereby tripping the switching mechanism 5.

The push shifter 10 and the pull shifter 11 of the differential shifter mechanism are arranged with the main bimetallic elements 9 in between, and are slidable along a row of the main bimetallic elements 9 in a direction that the main bimetallic elements 9 bend and restore. The push shifter 10 has arms 10*a* projecting in a direction perpendicular to the row of the main bimetallic elements 9 at positions corresponding to the main bimetallic elements 9, respectively. The pull shifter 11 has arms 11*a* projecting in a direction perpendicular to the row of the main bimetallic elements 9 at positions corresponding to the main bimetallic elements 9, respectively. With this structure, the main bimetallic elements 9 are held between the arms 10*a* and 11*a* at the positions corresponding to the main bimetallic elements 9 in the direction that the main bimetallic elements 9 bend and restore.

The differential lever 12 is connected to the push shifter 10 and the pull shifter 11. More specifically, the differential lever 12 has one end at a side of the pull shifter 11 pivotally supported on an upper surface of the pull shifter 11 through a coupling pin 14. The differential shifter 12 is connected to the push shifter 10 through a link pin 15 fitted into a guiding long hole 10*b* (long hole extending in a direction perpendicular to a sliding direction of the shifter) formed in the push shifter 10 with a plate shape. The differential lever 12 has an action end 12*a* projecting toward and facing the tripping lever 13 at the other end thereof opposite to the coupling pin 14.

The tripping lever 13 has a pivot 13*a* on a center line thereof, so that the tripping lever 13 is supported to be rotatable around the pivot 13*a* as a lever device. The tripping lever 13 has one end facing the action end 12*a* of the differential lever 12 and the other end facing the latch receiver 5*a* of the switching mechanism 5.

Japanese Patent Publication (Kokai) No. 2002-298723 has described an operation of the overload/open-phase tripping device 8 in detail. When an overload current flows in the main circuit while supplying power to a load, the main bimetallic elements 9 of the respective phases bend in a specific direction. As a result, as shown in FIG. 7, the main bimetallic elements 9 push the push shifter 10 to move in a direction of leftward arrows. Then, the differential lever 12 connected to the push shifter 10 through the link pin 15 fitted in the guiding long hole 10*a* follows the push shifter 10 to move in the direction of the leftward arrows, so that the movement is transmitted to the tripping lever 13 through the action end 12*a*.

In the process of the movement, the pull shifter 11 connected to the differential lever 12 through the coupling pin 14 moves in the arrow direction while following the movement of the push shifter 10. Accordingly, the differential lever 12 moves in parallel in the arrow direction while maintaining an initial posture to push the tripping lever 13 leftward with a thrust force f1. When the tripping lever 13 rotates clockwise around the pivot 13*a* to press the latch receiver 5*a* to an open position, the switching mechanism 5 (see FIG. 5) performs a tripping operation, thereby opening the main circuit contacts of the current cutoff section 6 to shut off the overload current.

When an open-phase occurs in the main circuit (S phase, for example) while power is supplied to a load, the overload/open-phase tripping device 8 operates as follows with reference to FIG. 8. When the S phase becomes the open-phase, a temperature of the main bimetallic element 9 corresponding to the S phase returns to a room temperature. As a result, the main bimetallic element 9 returns to an initial state (non-energized state) with no deformation to push back the pull shifter 11 in the rightward arrow direction.

Since currents continue to flow in the R and T phases, the main bimetallic elements 9 corresponding to the R and T phases keep pushing the push shifter 10 in the leftward arrow direction. Accordingly, the differential lever 12 rotates clockwise around the coupling pin 14, so that the action end 12*a* pushes the tripping lever 13 leftward with a thrust force f2. As a result, similar to the tripping operation upon the overload shown in FIG. 7, the tripping lever 13 drives the latch receiver 5*a* into the open position, so that the circuit breaker performs the tripping operation.

The overload/open-phase tripping device with the conventional structure described above has the following functional problems. In the operation, upon the overload shown in FIG. 7, the main bimetallic elements 9 in the R, S and T phases cooperatively push the push shifter 10. The differential lever 12 follows the main bimetallic elements 9, and the action end 12*a* pushes the tripping lever 13 with the thrust force f1. On the other hand, in the operation, upon the open-phase shown in FIG. 8, the main bimetallic elements 9 in the R and T phases push the push shifter 10, and the main bimetallic element 9 in the S phase does not push. Accordingly, the action end 12*a* of the differential lever 12 pushes the tripping lever 13 with the force f2 smaller than the force f1 in the operation upon the overload by about 40% (f1>f2).

Further, the differential lever 12 applies a force to the tripping lever 13 at the same action point in the operations upon both the overload and the open-phase. As a result, a moment of the force applied to the tripping lever 13 is L1×f1 upon the overload and L1×f2 upon the open-phase, wherein L1 is a length between the pivot 13*a* and the action point (action end 12*a* of the differential lever 12; see FIG. 6). Accordingly, the operation upon the overload generates the moment larger than that in the operation upon the open-phase.

When the switching mechanism 5 performs the tripping operation; it is necessary to apply a specific constant load to the latch receiver 5*a*. Incidentally, in the operation upon the open-phase, the action end 12*a* of the differential lever 12 moves for a distance greater than that in the operation upon the overload. Accordingly, in the conventional tripping device, in order to obtain a stable tripping operation of the circuit breaker upon the open-phase and the overload, it is necessary to increase a size of the main bimetallic elements 9 so that the differential shifter mechanism can apply a sufficient force to the tripping lever 13. Further, it is necessary to manufacture and assemble the differential shifter mechanism with high accuracy and provide fine adjustment.

However, when the main bimetallic elements in the circuit breaker have a large size, it is difficult to reduce a size of the circuit breaker. Further, the differential shifter mechanism needs to be produced and assembled with high accuracy, thereby increasing cost.

In view of the problems described above, the invention has been made, and an object of the invention is to provide an overload/open-phase tripping device for a circuit breaker in which a differential shifter mechanism is optimized to generate a proper force with high efficiency, thereby obtaining a stable tripping operation upon the overload and the open-phase.

SUMMARY OF THE INVENTION

In order to achieve the above objects, according to the invention, an overload/open-phase tripping device for a circuit breaker includes: a plurality of bimetallic elements arranged in a row and corresponding to respective phases of a main circuit; a differential shifter mechanism contacting the bimetallic elements for operating through a deformation of the bimetallic elements; and a tripping lever arranged to be rotatable around a pivot for transmitting a force applied by the differential shifter mechanism to a switching mechanism.

The differential shifter mechanism includes: a push shifter disposed on one side of the main bimetallic elements and having a plurality of operation ends contacting the main bimetallic elements; a pull shifter disposed on the other side of the main bimetallic elements and having a plurality of operation ends contacting the main bimetallic elements; and a differential lever disposed between the push shifter and the pull shifter and facing a tripping lever for applying the force to the tripping lever. The push shifter is arranged to be movable in directions of bending and restoration of the main bimetallic elements, and is moved toward the bending direction thereof. The pull shifter is arranged to be movable in the direction of the bending and restoration of the main bimetallic elements, and is moved toward the restoration direction thereof.

The differential lever has one end connected to the pull shifter with a coupling pin to be rotatable around the coupling pin. The differential lever is connected to the push shifter with a pin provided on one of the differential lever and the push shifter and a guide hole provided in the other. The differential lever is provided with two action ends, i.e. an action end for applying the force to the tripping lever through the operation upon an overload, and an action end for applying the force to the tripping lever through the operation upon an open-phase. The two action ends face the tripping lever, and the action end for the open-phase is located at a position farther from the pivot of the tripping lever than the action end for the overload.

The action end for the overload may be formed on a side of the coupling pin pivotally connecting the differential lever to the pull shifter. The action end for the open-phase may be formed at the other end extending over the push shifter.

The action end for the open-phase formed on the differential lever, the coupling pin connecting the differential lever to the pull shifter, and the pin and the guide hole connecting the differential lever to the push shifter may be arranged on a straight line in parallel with the tripping lever. Accordingly, it is possible to increase a transmission efficiency of the force applied from the differential shifter mechanism to the tripping lever.

According to the present invention, the main bimetallic elements apply the force to the tripping lever through the action ends of the differential shifter mechanism. With the principle of lever, when the action end for the open-phase applies the force to the tripping lever through the operation upon the open-phase, a moment of the force around the pivot of the tripping lever becomes greater than a moment around the pivot of the tripping lever when the action end for the overload applies the force to the tripping lever through the operation upon the overload. Accordingly, it is possible to provide a sufficient force transmitted from the main bimetallic elements to the tripping lever through the differential shifter mechanism, thereby obtaining a stable tripping operation of the circuit breaker upon both the open-phase and the overload.

As compared with a conventional differential shifter mechanism, in which an action end of a differential lever applies a force at a same action point upon both the overload and the open-phase, it is possible to reduce a size of the main bimetallic elements, thereby making the circuit breaker compact. Further, it is possible to relax requirements in dimensional and assembling accuracy for the differential shifter mechanism, thereby reducing cost.

Furthermore, the action end for the open-phase of the differential lever, the coupling pin connecting the pull shifter to the differential lever, and the link pin connecting the push shifter to the differential lever are arranged on a straight line in parallel with the tripping lever. Accordingly, it is possible to apply the force of the differential shifter mechanism to the tripping lever in a substantially perpendicular direction, thereby obtaining high transmission efficiency.

DETAILED DESCRIPTION OF PREFERRED EMBODIMENTS

Figure 1:
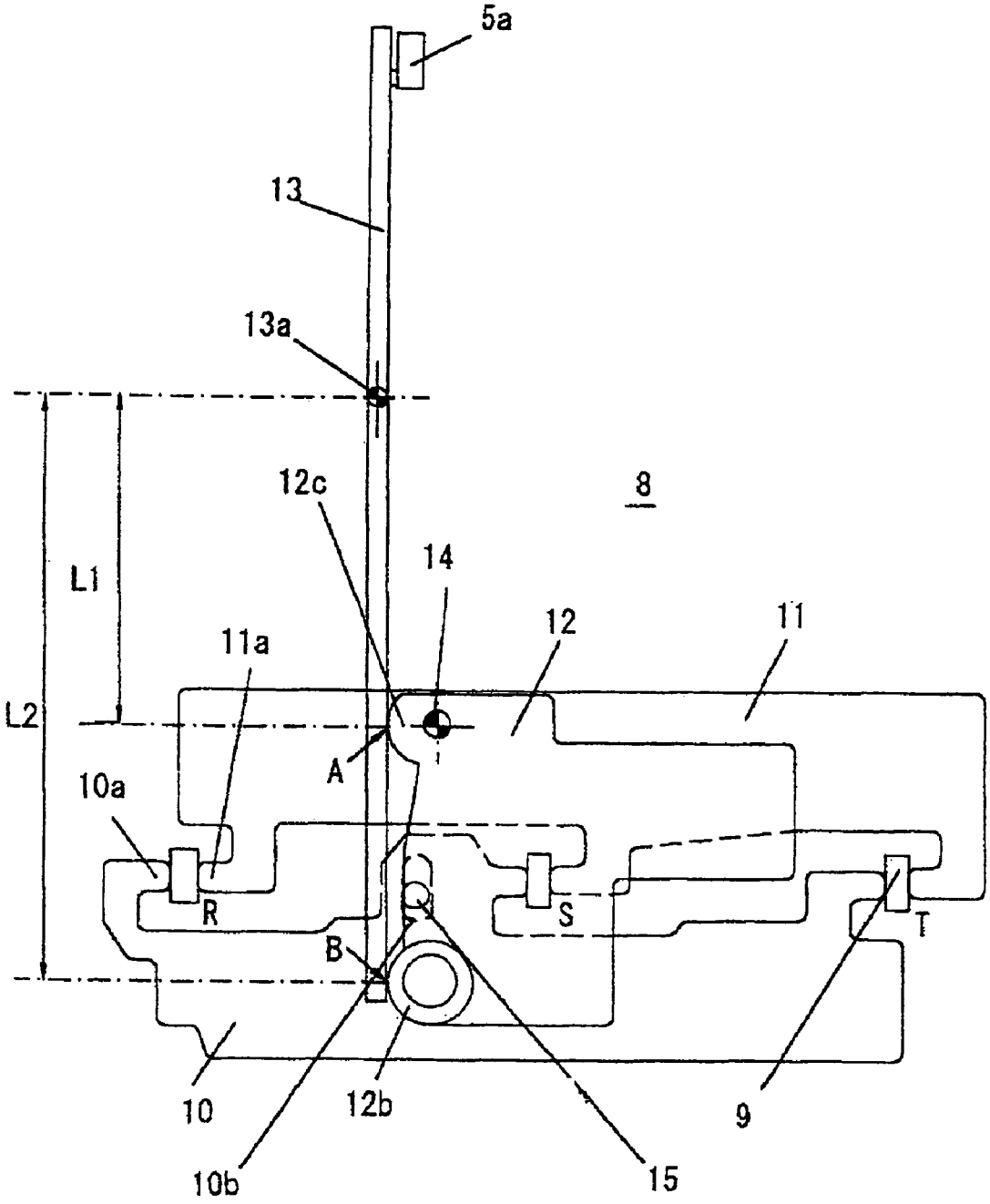
FIG. 1 is a schematic diagram showing an overload/open-phase tripping device according to an embodiment of the invention.

Hereunder, embodiments of the present invention will be explained with reference to the accompanying drawings. In the drawings, components same as those shown in FIG. 6 are denoted by the same reference numerals, and the descriptions thereof are omitted.

Figure 2:
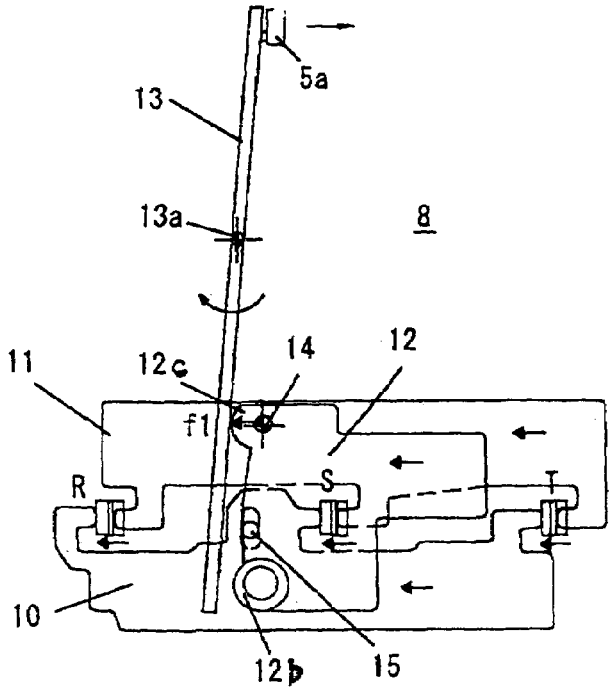
FIG. 2 is an explanatory view showing an operation of the overload/open-phase tripping device shown in FIG. 1 upon an overload.
Figure 3:
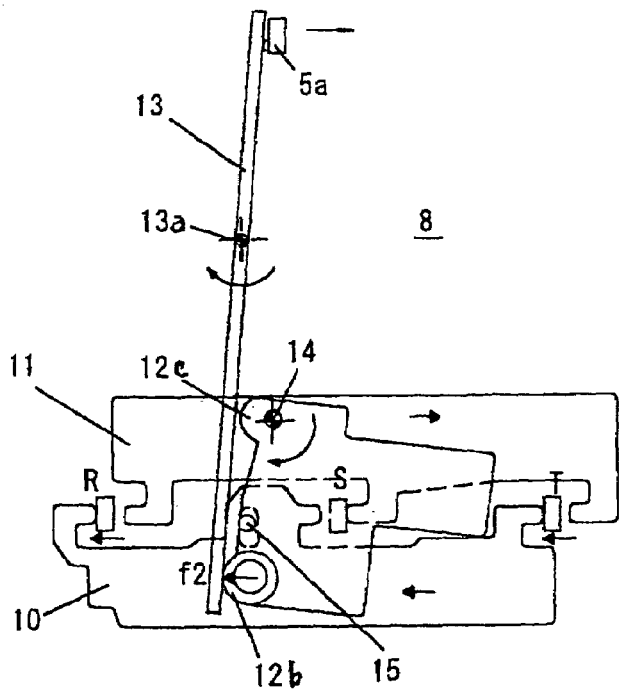
FIG. 3 is an explanatory view showing an operation of the overload/open-phase tripping device shown in FIG. 1 upon an open-phase.

An embodiment of the present invention is shown in FIG. 1 to FIG. 3. In the embodiment, a differential lever 12 has a structure basically same as that shown in FIG. 6, except that an action end for an operation upon an overload and an action end for an operation upon an open-phase are formed separately at different positions.

Figure 6:
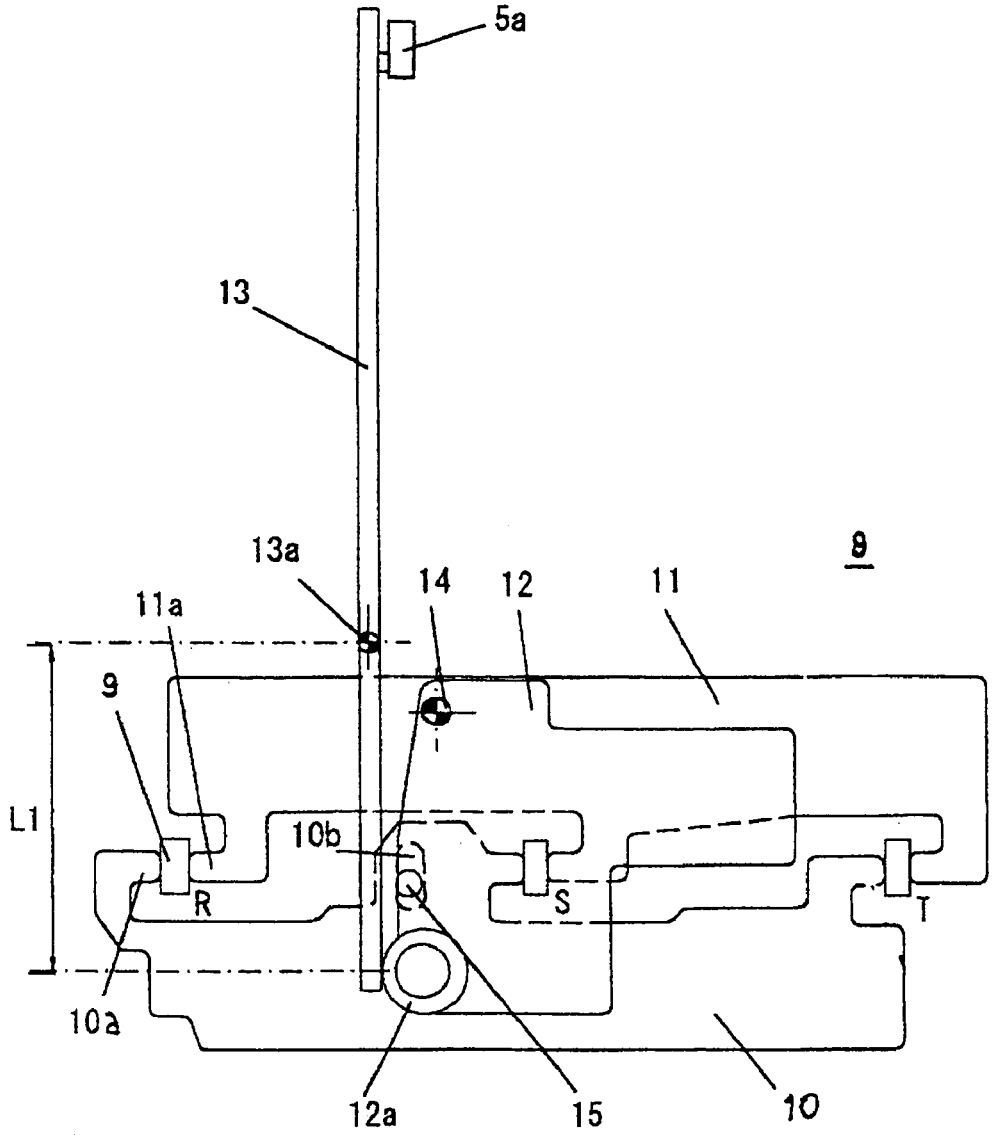
Fig. 6 Prior Art
FIG. 6 is a view showing a conventional overload/open-phase tripping device mounted on the circuit breaker shown in FIGS. 5(*a*) and 5(*b*)

Namely, in the conventional differential shifter mechanism in FIG. 6, a single action end 12*a* is formed on the differential lever 12. In the embodiment, an action end 12*b* is provided for the open-phase, and another action end 12*c* for the overload is separately formed at a side of a coupling pin 14 to face a tripping lever 13. The coupling pin 14 pivotally connects the differential lever 12 to a pull shifter 11. In accordance with the formation of the action end for the overload 12*c*, a pivot 13*a* of the tripping lever 13 is shifted toward a position close to a latch receiver 5*a* from a position shown in FIG. 6. Accordingly, as compared with a length L1 shown in FIG. 6, a length L1 between the pivot 13*a* and the action end for the overload 12*c* becomes smaller than a length L2 between the pivot 13*a* and the action end for the open-phase 12*b* (L2>L1).

An operation of the differential shifter mechanism upon the overload and open-phase will be explained next with reference to FIG. 2 and FIG. 3. Similar to an operation shown in FIG. 7, when overload currents flow in respective circuits in R, S, and T phases, the respective main bimetallic elements 9 in the R, S, and T phases bend. As a result, a push shifter 10, the pull shifter 11, and the differential lever 12 move in a direction of leftward arrows while maintaining their initial positional relation (see FIG. 2). Accordingly, the action end for the overload 12*c* pushes the tripping lever 13 with a force f1 to transmit a force applied by the differential lever to a latch receiver 5*a* of the switching mechanism, thereby tripping the circuit breaker. In this case, a moment of the force acting on the tripping lever 13 is L1×f1, wherein L1 is the length between the pivot 13*a* of the tripping lever 13 and a point of action A (see FIG. 1) of the action end for the overload 12*c* to the tripping lever 13.

On the other hand, when the open-phase occurs (in the S phase, for example), as shown in FIG. 3, the main bimetallic element 9 in the S phase restores, so that the pull shifter 11 is pushed back rightward to the initial position (see FIG. 1). At the same time, the main bimetallic elements 9 in the R and T phases (energized) push the push shifter 10 in a direction of leftward arrows. Accordingly, the differential lever 12 is rotated clockwise around the coupling pin 14 to push the tripping lever 13 through the action end 12*b* with a force f2. In this case, a moment of the force acting on the tripping lever 13 is L2×f2, wherein L2 is the length between the pivot 13*a* of the tripping lever 13 and a point of action B (see FIG. 1) of the action end for the open-phase 12*b* to the tripping lever 13.

Figure 7:
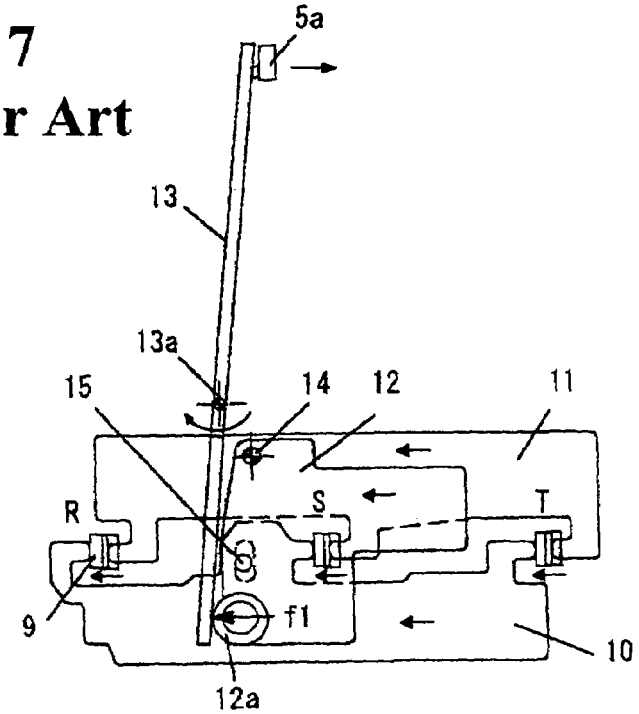
Fig. 7 Prior Art
FIG. 7 is an explanatory view showing an operation of the conventional overload/open-phase tripping device shown in FIG. 6 upon the overload.
Figure 8:
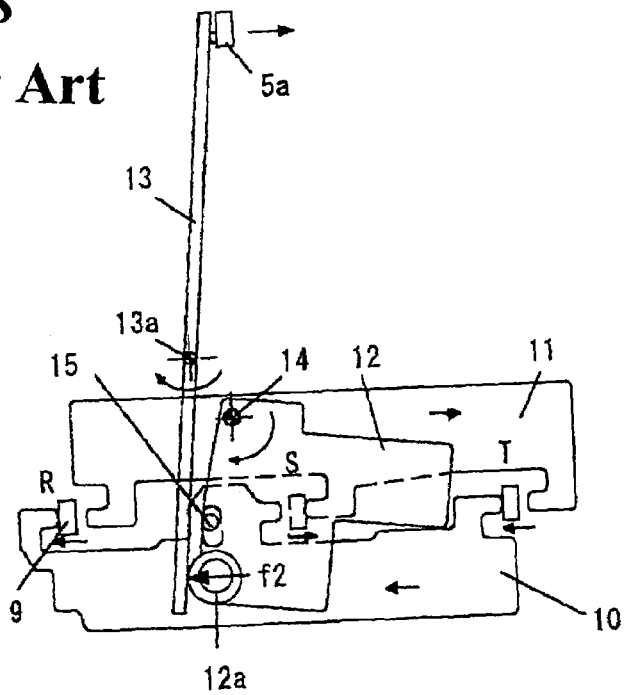
Fig. 8 Prior Art
FIG. 8 is an explanatory view showing an operation of the conventional overload/open-phase tripping device shown in FIG. 6 upon the open-phase.

Here, the differential shifter mechanism applies the forces (moments of the forces) to the tripping lever 13 as follows. As shown in FIG. 7 and FIG. 8, in the operation upon the overload, the action end 12*a* of the differential lever 12 pushes the tripping lever 13 with the force f1 larger than the force f2 with which the action end 12*a* pushes the tripping lever 13 in the operation upon the open-phase (f1>f2).

In the differential lever 12 of the embodiment, the action end for the open-phase 12*b* and the action end for the overload 12*c* are arranged separately at different positions. Accordingly, the length L1 between the pivot 13*a* of the tripping lever 13 and the point of action A of the force f1 is smaller than the length L2 between the pivot 13*a* and the point of action B of the force f2 (L1<L2), i.e. a reversed relationship of the forces. Therefore, by adjusting the lengths L1 and L2, it is possible to make the moment L1×f1 equal to the moment L2×f2. Accordingly, it is possible to stably drive the latch receiver 5*a* of the switching mechanism to an open position with the tripping lever 13, thereby tripping the circuit breaker upon both the open-phase and the overload.

Figure 4:
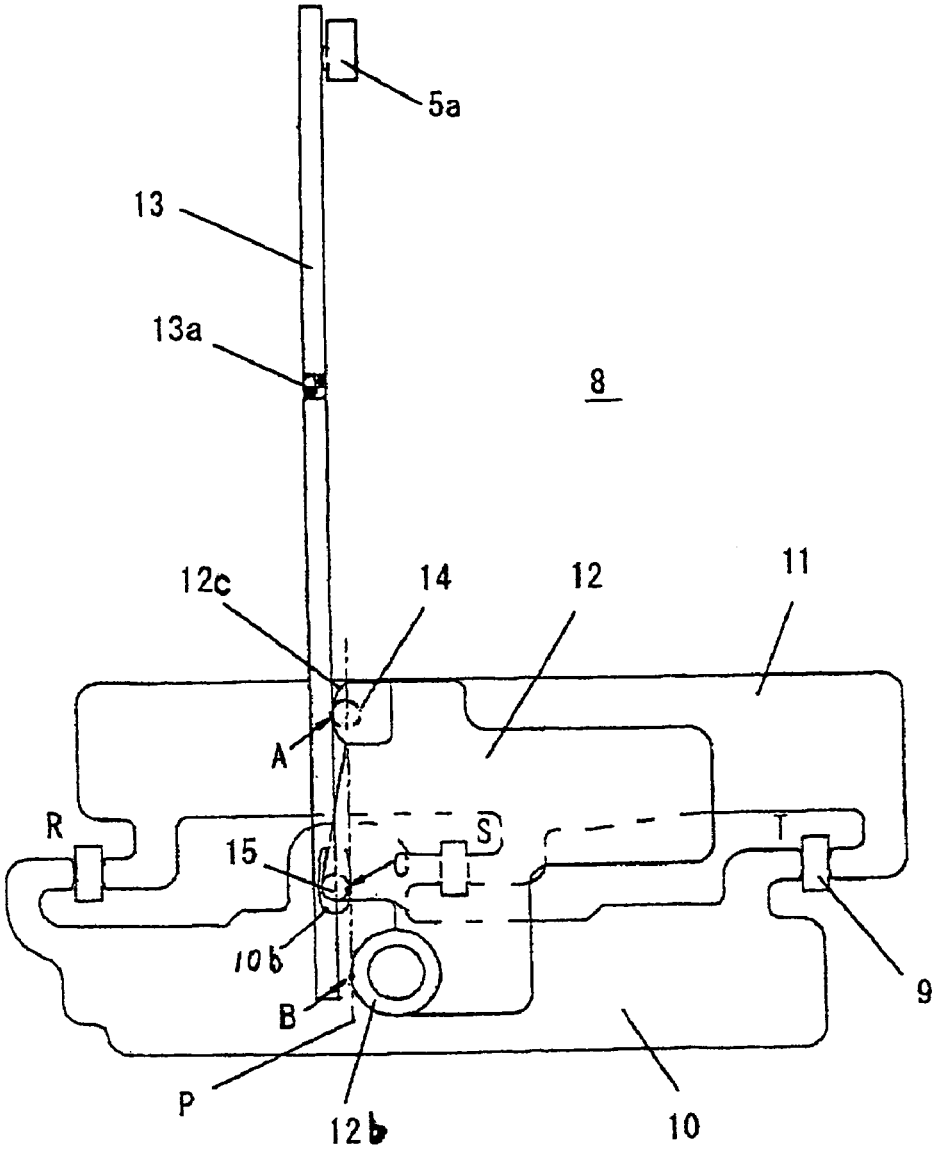
FIG. 4 is a schematic diagram showing an overload/open-phase tripping device according to another embodiment of the invention.
Figure 5A:
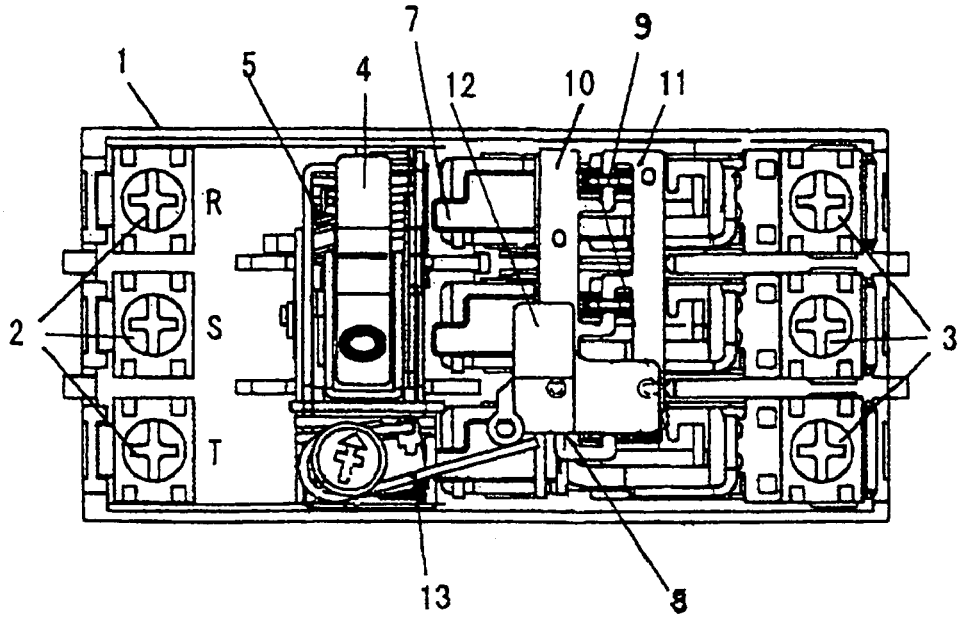
Fig. 5(a) Prior Art
FIGS. 5(*a*) and 5(*b*) are views showing an inner structure of a circuit breaker with a top lid removed, wherein FIG. 5(*a*) is a plan view thereof and FIG. 5(*b*) is a side view thereof.
Figure 5B:
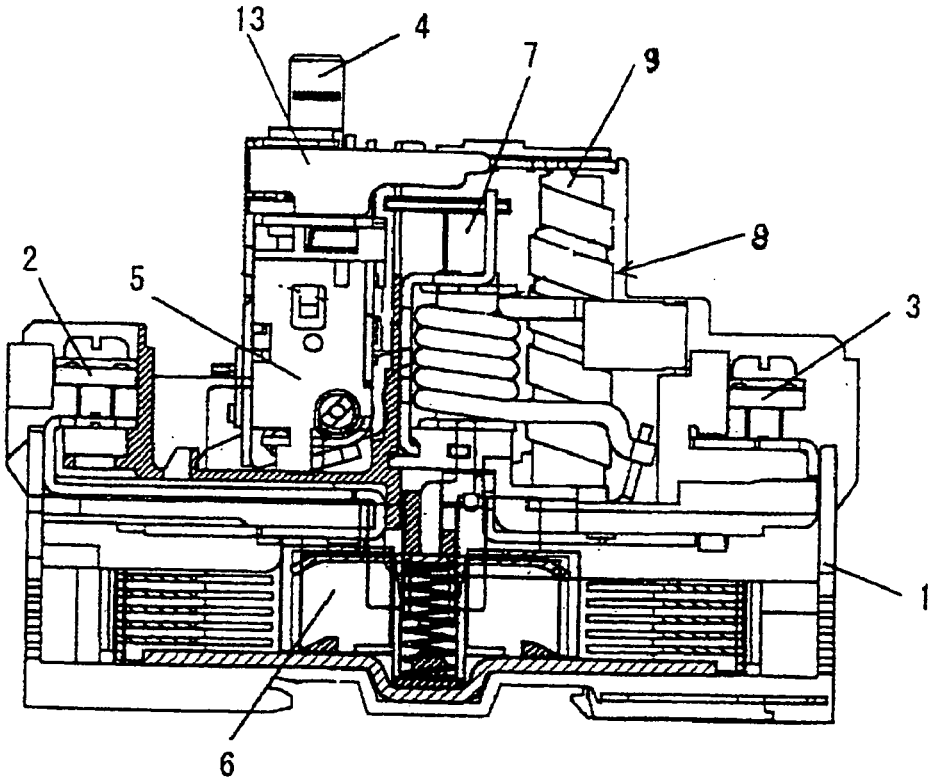
Fig. 5(b) Prior Art

Another embodiment of the invention is shown in FIG. 4. In the embodiment, a differential shifter mechanism has a structure basically same as that shown in FIG. 1. The action end for the open-phase 12*b* formed on the differential lever 12, the coupling pin 14 connecting the differential lever 12 to the pull shifter 11, and the link pin 15 connecting the differential lever 12 to the push shifter 10 are arranged as follows. Namely, an end surface of the action end for the open-phase 12*b* (point of action B pushing the tripping lever 13), the center of the coupling pin 14, and a contact point between the link pin 15 and the guiding long hole 10 formed in the push shifter 10 (point of action C of the push-shifter 10 pushing the differential lever 12) are positioned on a straight line P. The straight line P is in parallel to the tripping lever 13 in the initial position.

With this arrangement, the differential shifter mechanism applies the force to the tripping lever 13 in a substantially perpendicular direction. Accordingly, it is possible to reduce a loss of the force, thereby improving transmission efficiency of the force.

The disclosure of Japanese Patent Application No. 2004-027174, filed on Feb. 3, 2004, is incorporated in the application.

While the invention has been explained with reference to the specific embodiments of the invention, the explanation is illustrative and the invention is limited only by the appended claims.

What is claimed is:

1. An overload/open-phase tripping device for tripping a circuit breaker upon an overload and an open-phase of a main circuit, comprising:

a plurality of bimetallic elements arranged in a row and corresponding to respective phases of the main circuit for generating forces upon the overload and the open-phase, a tripping lever disposed to be rotatable around a pivot for transmitting the forces to a switching mechanism of the circuit breaker, and a differential shifter mechanism disposed between the bimetallic elements and the tripping lever for transmitting the forces to the tripping lever, said differential shifter mechanism including a push shifter disposed on one side of each of the bimetallic elements to be movable in a direction of deformation of the bimetallic elements and having first operation ends contacting the respective bimetallic elements, a pull shifter disposed on the other side of each of the bimetallic elements to be movable in a deformation returning direction of the bimetallic elements and having second operation ends contacting the respective bimetallic elements; and a differential lever disposed between the push shifter and the pull shifter for applying the forces to the tripping lever, said differential lever being rotationally connected to the pull shifter and slidably rotationally connected to the push shifter, said differential lever having a first action end for applying the force to the tripping lever upon the overload and a second action end for applying the force to the tripping lever upon the open-phase.

2. An overload/open-phase tripping device according to claim 1, wherein said differential lever is rotationally connected to the pull shifter with a first pin and connected to the push shifter with a second pin provided on one of the differential lever and the push shifter and a guide hole provided in the other of the differential lever and the push shifter, said first action end being arranged at a position closer to the pivot of the tripping lever than the second action end.

3. An overload/open-phase tripping device according to claim 2, wherein said differential lever includes one side having the first action end located at one end thereof and next to the first pin connected to the pull shifter, and the second action end located at the other end thereof and placed over the push shifter.

4. An overload/open-phase tripping device according to claim 2, wherein said differential lever is arranged such that the second action end, the first pin, the second pin and the guide hole are arranged on a straight line in parallel with the tripping lever.

* * * * *

UNITED STATES PATENT AND TRADEMARK OFFICE

CERTIFICATE OF CORRECTION

PATENT NO. : 6,940,374 B2 
DATED : September 6, 2005
INVENTOR(S) : Isamu Nagahiro and Katsunori Kuboyama It is certified that error appears in the above-identified patent and that said Letters Patent is hereby corrected as shown below:

Column 6,
Line 37, please change "push-shifter" to -- push shifter --.

Signed and Sealed this

Twenty-second Day of November, 2005

JON W. DUDAS
*Director of the United States Patent and Trademark Office*